US008725460B2

(12) United States Patent
Huang et al.

(10) Patent No.: US 8,725,460 B2
(45) Date of Patent: May 13, 2014

(54) ALERTING APPARATUS FOR FAN FAILURE AND METHOD FOR THE SAME

(75) Inventors: Yueh-Lung Huang, Taoyuan Shien (TW); Yen-Hung Chen, Taoyuan Shien (TW); Chia-Ching Tsai, Taoyuan Shien (TW)

(73) Assignee: Delta Electronics, Inc., Taoyuan County (TW)

( * ) Notice: Subject to any disclaimer, the term of this patent is extended or adjusted under 35 U.S.C. 154(b) by 351 days.

(21) Appl. No.: 13/198,096

(22) Filed: Aug. 4, 2011

(65) Prior Publication Data

US 2012/0274259 A1 Nov. 1, 2012

(30) Foreign Application Priority Data

Apr. 29, 2011 (TW) ..... 100115022 A

(51) Int. Cl.
*G06F 11/30* (2006.01)

(52) U.S. Cl.
USPC ..... 702/183

(58) Field of Classification Search
USPC ..... 702/183
See application file for complete search history.

(56) References Cited

U.S. PATENT DOCUMENTS

2008/0140353 A1* 6/2008 Koehl ..... 702/185

* cited by examiner

*Primary Examiner* — Stephen Cherry
(74) *Attorney, Agent, or Firm* — Muncy, Geissler, Olds & Lowe, P.C.

(57) ABSTRACT

An alerting method for fan failure first reads a target value of rotating speed of a fan motor. Predetermining values of each parameters of the fan motor is calculated according to the target value of rotating speed of the fan motor. If a current value of rotating speed of the fan motor is lower than the target value of rotating speed of the fan motor, the failure recorded in a counter is added one time. If a current peak value of the fan motor is higher than a first predetermining current value, the failure recorded in the counter is added one time. If the duration of the current which is higher than a second predetermining current value of the fan motor is higher than a predetermining duration, the failure recorded in the counter is added one time. An alarm signal is sent if the failure recorded in the counter is larger than a predetermining time.

9 Claims, 4 Drawing Sheets

ALERTING APPARATUS FOR FAN FAILURE AND METHOD FOR THE SAME

BACKGROUND OF THE INVENTION

1. Field of the Invention

The present invention relates to an alerting apparatus and method for the same, and in particular to an alerting apparatus for fan failure and method for the same.

2. Description of Prior Art

Modern people use fans very often, for example, for ventilating, or cooling for computers or instruments. Our living and the technology developments are quite inconvenient without fans.

Currently the ordinary method for detecting fan failure is mainly to detect the rotating speed of the fan. When the rotating speed of the fan is in the range of the predetermining rotating speed, the fan is judged as normal. When the rotating speed of the fan is less than the predetermining rotating speed, the fan is judged as abnormal.

However, the disadvantage of the method mentioned above is that the fan failure cannot be predicted. When the rotating speed of the fan is less than the predetermining rotating speed then alarms, computers or instruments often get damaged due to the raise of the temperature.

SUMMARY OF THE INVENTION

In order to solve the above-mentioned problems, an object of the present invention is to provide an alerting method for fan failure.

In order to solve the above-mentioned problems, another object of the present invention is to provide an alerting apparatus for fan failure.

In order to achieve the object of the present invention mentioned above, the alerting method for fan failure of the present invention includes following steps. A target value of rotating speed of a fan motor is read by a microprocessor from a customer system. Predetermining values of each parameters of the fan motor is calculated according to the target value of rotating speed of the fan motor by the microprocessor. A current value of rotating speed of the fan motor is read by the microprocessor. When the current value of rotating speed of the fan motor is lower than the target value of rotating speed of the fan motor compared by the microprocessor, the failure recorded in a counter is added one time by the microprocessor. A current peak value of the fan motor is read by the microprocessor. When the current peak value of the fan motor is higher than a first predetermining current value compared by the microprocessor, the failure recorded in the counter is added one time by the microprocessor. A duration of the current which is higher than a second predetermining current value of the fan motor is read by the microprocessor. When the duration is longer than a predetermining duration compared by the microprocessor, the failure recorded in the counter is added one time by the microprocessor. An alarm signal is sent from the microprocessor when the failure recorded in the counter is larger than a predetermining time compared by the microprocessor.

In order to achieve another object of the present invention mentioned above, the alerting apparatus for fan failure of the present invention is applied to a customer system. The alerting apparatus for fan failure includes a microprocessor electrically connected to the customer system, a fan motor electrically connected to the microprocessor, and a counter electrically connected to the microprocessor. A target value of rotating speed of the fan motor is read by the microprocessor from the customer system. Predetermining values of each parameters of the fan motor is calculated according to the target value of rotating speed of the fan motor by the microprocessor. A current value of rotating speed of the fan motor is read by the microprocessor. When the current value of rotating speed of the fan motor is lower than the target value of rotating speed of the fan motor compared by the microprocessor, the failure recorded in the counter is added one time by the microprocessor. A current peak value of the fan motor is read by the microprocessor. When the current peak value of the fan motor is higher than a first predetermining current value compared by the microprocessor, the failure recorded in the counter is added one time by the microprocessor. A duration of the current which is higher than a second predetermining current value of the fan motor is read by the microprocessor. When the duration is longer than a predetermining duration compared by the microprocessor, the failure recorded in the counter is added one time by the microprocessor.

The efficiency of the present invention is to predict the fan motor will fail.

DETAILED DESCRIPTION OF THE INVENTION

Figure 2:
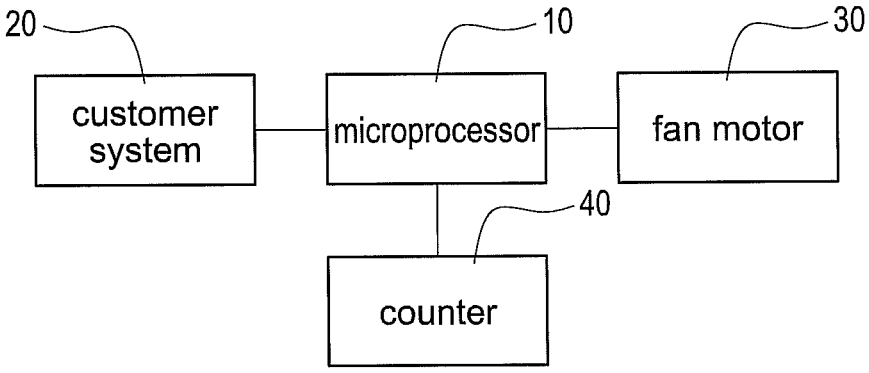
FIG. 2 shows a block diagram of the alerting apparatus for fan failure of the present invention.

FIG. 2 shows a block diagram of the alerting apparatus for fan failure of the present invention. The alerting apparatus for fan failure of the present invention is applied to a customer system 20. The alerting apparatus for fan failure includes a microprocessor 10, a fan motor 30, and a counter 40. The microprocessor 10 is electrically connected to the fan motor 30, the customer system 20, and the counter 40.

Figure 1A:
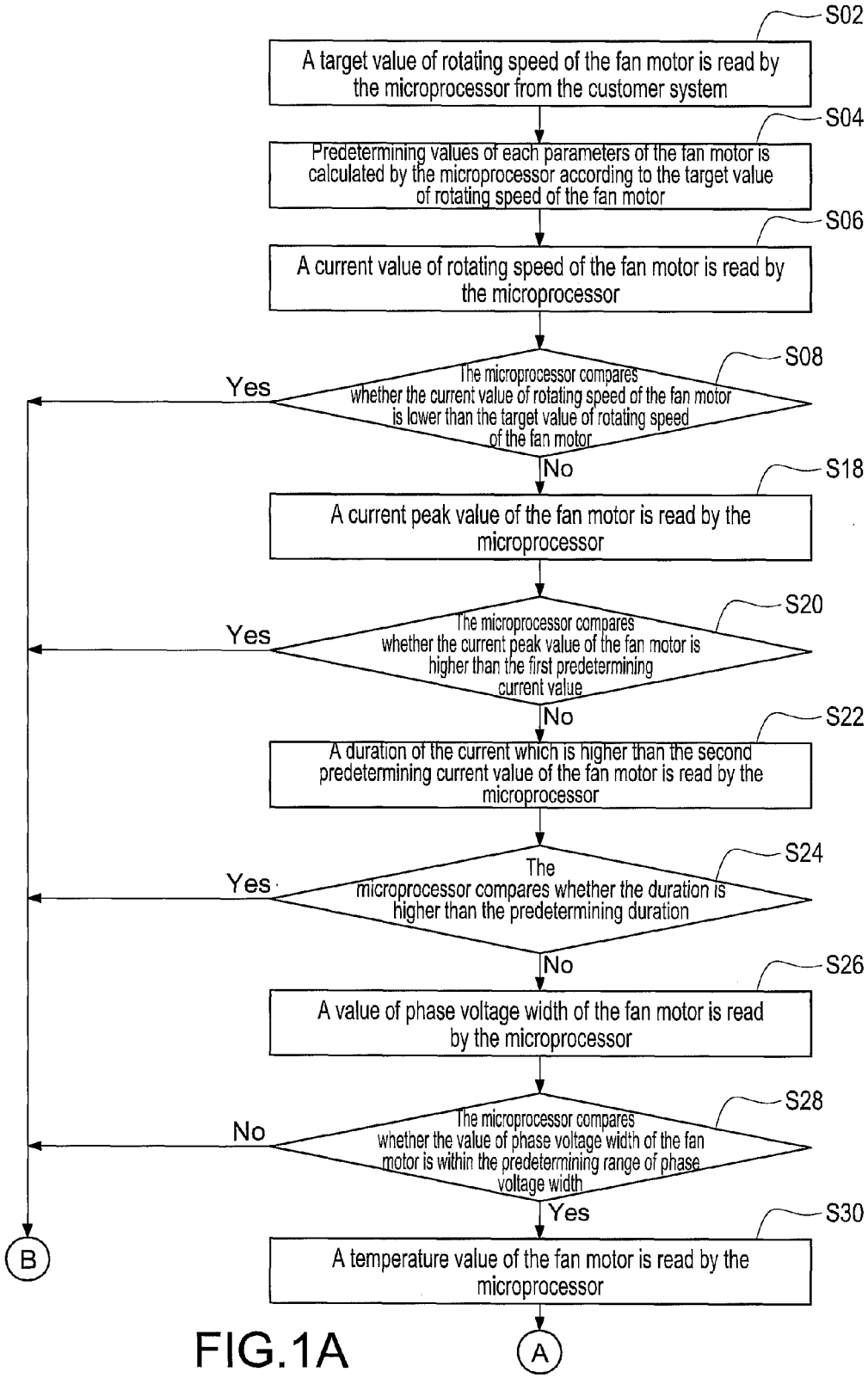
FIG. 1A shows a part of the flow chart of the alerting method for fan failure of the present invention.
Figure 1B:
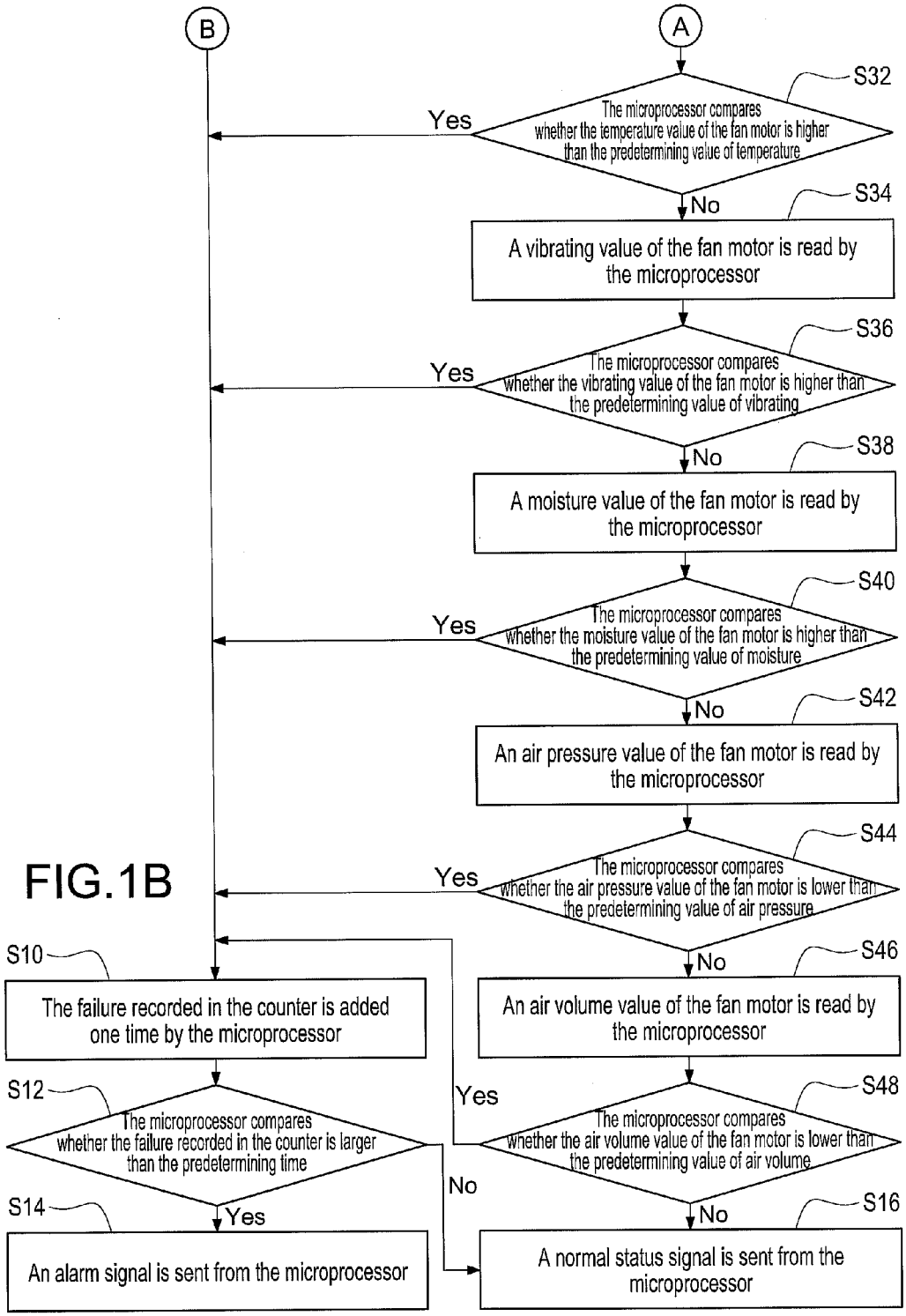
FIG. 1B shows the other part of the flow chart of the alerting method for fan failure of the present invention.

FIG. 1A shows a part of the flow chart of the alerting method for fan failure of the present invention. FIG. 1B shows the other part of the flow chart of the alerting method for fan failure of the present invention. Please refer to FIG. 2 as well. The alerting method for fan failure of the present invention includes following steps.

S02: A target value of rotating speed of the fan motor 30 is read by the microprocessor 10 from the customer system 20. For example, the target value of rotating speed of the fan motor 30 should be 1000 RPM set by the user or the host system. Accordingly, the microprocessor 10 knows that the target value of rotating speed of the fan motor 30 should be 1000 RPM.

S04: Predetermining values of each parameters of the fan motor 30 is calculated by the microprocessor 10 according to the target value of rotating speed of the fan motor 30. For example, after the microprocessor 10 knows that the target value of rotating speed of the fan motor 30 should be 1000 RPM, the predetermining values of each parameters of the fan motor 30 is calculated by the microprocessor 10.

Each parameters mentioned above include, for example, a first predetermining current value, a second predetermining current value, a predetermining duration, a predetermining time, a predetermining range of phase voltage width, a predetermining value of temperature, a predetermining value of vibrating, a predetermining value of moisture, a predetermining value of air pressure, and a predetermining value of air volume.

S06: A current value of rotating speed of the fan motor 30 is read by the microprocessor 10.

S08: The microprocessor 10 compares whether the current value of rotating speed of the fan motor 30 is lower than the target value of rotating speed of the fan motor 30. If yes, the method of the present invention goes to step S10. If no, the method of the present invention goes to step S18.

S10: The failure recorded in the counter 40 is added one time by the microprocessor 10.

S12: The microprocessor 10 compares whether the failure recorded in the counter 40 is larger than the predetermining time. If yes, the method of the present invention goes to step S14. If no, the method of the present invention goes to step S16.

S14: An alarm signal is sent from the microprocessor 10. For example, the alarm signal is sent from the microprocessor 10 to the customer system 20 to inform the customer system 20 that the fan motor 30 is abnormal or will fail. Or, a light emitting diode or a buzzer is driven by the microprocessor 10 to inform the user that the fan motor 30 is abnormal or will fail.

S16: A normal status signal is sent from the microprocessor 10.

S18: A current peak value of the fan motor 30 is read by the microprocessor 10.

Figure 3:
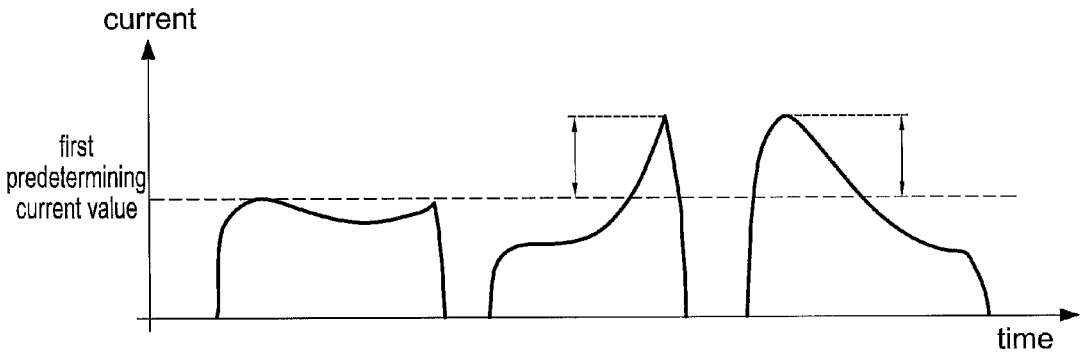
FIG. 3 shows an exemplary diagram to demonstrate the judgment whether the current peak value is higher than the first predetermining current value.

S20: The microprocessor 10 compares whether the current peak value of the fan motor 30 is higher than the first predetermining current value. If yes, the method of the present invention goes to step S10. If no, the method of the present invention goes to step S22. FIG. 3 shows an exemplary diagram to demonstrate the judgment whether the current peak value is higher than the first predetermining current value. The current waveform at the left side is normal. The current waveforms at the middle and at the right side are abnormal (the current peak value is higher than the first predetermining current value).

S22: A duration of the current which is higher than the second predetermining current value of the fan motor 30 is read by the microprocessor 10.

Figure 4:
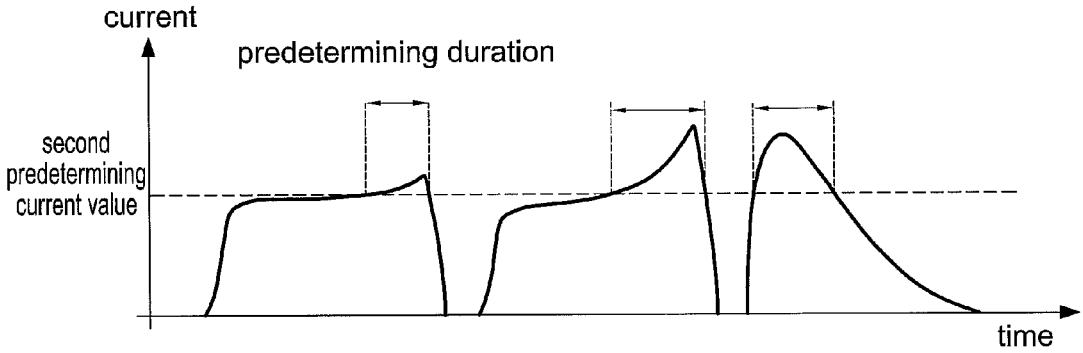
FIG. 4 shows an exemplary diagram to demonstrate the judgment whether the duration of the current which is higher than the second predetermining current value is longer than the predetermining duration.

S24: The microprocessor 10 compares whether the duration is longer than the predetermining duration. If yes, the method of the present invention goes to step S10. If no, the method of the present invention goes to step S26. FIG. 4 shows an exemplary diagram to demonstrate the judgment whether the duration of the current which is higher than the second predetermining current value is longer than the predetermining duration. The current waveform at the left side is normal. The current waveforms at the middle and at the right side are abnormal (the duration is longer than the predetermining duration).

S26: A value of phase voltage width of the fan motor 30 is read by the microprocessor 10.

S28: The microprocessor 10 compares whether the value of phase voltage width of the fan motor 30 is within the predetermining range of phase voltage width. If no (the value of phase voltage width is higher than the maximum of the predetermining range of phase voltage width, or lower than the minimum of the predetermining range of phase voltage width), the method of the present invention goes to step S10. If yes, the method of the present invention goes to step S30.

S30: A temperature value of the fan motor 30 is read by the microprocessor 10.

S32: The microprocessor 10 compares whether the temperature value of the fan motor 30 is higher than the predetermining value of temperature. If yes, the method of the present invention goes to step S10. If no, the method of the present invention goes to step S34.

S34: A vibrating value of the fan motor 30 is read by the microprocessor 10.

S36: The microprocessor 10 compares whether the vibrating value of the fan motor 30 is higher than the predetermining value of vibrating. If yes, the method of the present invention goes to step S10. If no, the method of the present invention goes to step S38.

S38: A moisture value of the fan motor 30 is read by the microprocessor 10.

S40: The microprocessor 10 compares whether the moisture value of the fan motor 30 is higher than the predetermining value of moisture. If yes, the method of the present invention goes to step S10. If no, the method of the present invention goes to step S42.

S42: An air pressure value of the fan motor 30 is read by the microprocessor 10.

S44: The microprocessor 10 compares whether the air pressure value of the fan motor 30 is lower than the predetermining value of air pressure. If yes, the method of the present invention goes to step S10. If no, the method of the present invention goes to step S46.

S46: An air volume value of the fan motor 30 is read by the microprocessor 10.

S48: The microprocessor 10 compares whether the air volume value of the fan motor 30 is lower than the predetermining value of air volume. If yes, the method of the present invention goes to step S10. If no, the method of the present invention goes to step S16.

The alerting apparatus for fan failure and method for the same of the present invention judges whether the current, the voltage, and other parameters of the fan motor are in the normal scopes against the target value of rotating speed, to inform that the fan motor is abnormal or the fan motor will fail. Compare to the prior art that only judges the rotating speed of the fan motor, the present invention can decrease the damage of the raise of the temperature for the computers or instruments.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An alerting method for fan failure, the alerting method comprising following steps:

a. a microprocessor reading a target value of rotating speed of a fan motor from a customer system;

b. the microprocessor calculating a first predetermining current value, a second predetermining current value, a predetermining duration, a predetermining time, a predetermining range of phase voltage width, a predetermining value of temperature, a predetermining value of vibrating, a predetermining value of moisture, a predetermining value of air pressure and a predetermining value of air volume according to the target value of rotating speed of the fan motor;

c. the microprocessor reading a current value of rotating speed of the fan motor;

d. the microprocessor adding one time in the failure recorded in a count when the current value of rotating speed of the fan motor is lower than the target value of rotating speed of the fan motor compared by the microprocessor;

e. the microprocessor reading a current peak value of the fan motor;

f. the microprocessor adding one time in the failure recorded in the count when the current peak value of the fan motor is higher than the first predetermining current value compared by the microprocessor;

g. the microprocessor reading a duration of the current which is higher than the second predetermining current value of the fan motor;

h. the microprocessor adding one time in the failure recorded in the count when the duration is longer than the predetermining duration compared by the microprocessor; and i. the microprocessor sending an alarm signal when the failure recorded in the count is larger than the predetermining time compared by the microprocessor.

2. The alerting method for fan failure in claim 1, the alerting method further comprising following step:

j. the microprocessor sending a normal status signal when the failure recorded in the count is less than or equal to the predetermining time compared by the microprocessor.

3. The alerting method for fan failure in claim 2, the alerting method further comprising following steps before step i:

u1. the microprocessor reading a value of phase voltage width of the fan motor;

u2. the microprocessor adding one time in the failure recorded in the count when the value of phase voltage width is higher than the maximum of the predetermining range of phase voltage width, or lower than the minimum of the predetermining range of phase voltage width compared by the microprocessor;

v1. the microprocessor reading a temperature value of the fan motor; and v2. the microprocessor adding one time in the failure recorded in the count when the temperature value of the fan motor is higher than the predetermining value of temperature compared by the microprocessor.

4. The alerting method for fan failure in claim 3, the alerting method further comprising following steps before step i:

w1. the microprocessor reading a vibrating value of the fan motor;

w2. the microprocessor adding one time in the failure recorded in the count when the vibrating value of the fan motor is higher than the predetermining value of vibrating compared by the microprocessor;

x1. the microprocessor reading a moisture value of the fan motor; and x2. the microprocessor adding one time in the failure recorded in the count when the moisture value of the fan motor is higher than the predetermining value of moisture compared by the microprocessor.

5. The alerting method for fan failure in claim 4, the alerting method further comprising following steps before step i:

y1. the microprocessor reading an air pressure value of the fan motor;

y2. the microprocessor adding one time in the failure recorded in the count when the air pressure value of the fan motor is lower than the predetermining value of air pressure compared by the microprocessor;

z1. the microprocessor reading an air volume value of the fan motor; and z2. the microprocessor adding one time in the failure recorded in the when the air volume value of the fan motor is lower than the predetermining value of air volume compared by the microprocessor.

6. An alerting apparatus for fan failure applied to a customer system, the alerting apparatus for fan failure comprising:

a microprocessor electrically connected to the customer system;

a fan motor electrically connected to the microprocessor; and a count electrically connected to the microprocessor, wherein the microprocessor reads a target value of rotating speed of the fan motor from the customer system, and the microprocessor is configured to calculate a first predetermining current value, a second predetermining current value, a predetermining duration, a predetermining time, a predetermining range of phase voltage width, a predetermining value of temperature, a predetermining value of vibrating, a predetermining value of moisture, a predetermining value of air pressure and a predetermining value of air volume according to the target value of rotating speed of the fan motor;

wherein the microprocessor reads a current value of rotating speed of the fan motor, and the microprocessor adds one time in the failure recorded in the count when the current value of rotating speed of the fan motor is lower than the target value of rotating speed of the fan motor compared by the microprocessor;

wherein the microprocessor reads a current peak value of the fan motor, and the microprocessor adds one time in the failure recorded in the count when the current peak value of the fan motor is higher than the first predetermining current value compared by the microprocessor;

wherein the microprocessor reads a duration of the current which is higher than the second predetermining current value of the fan motor, and the microprocessor adds one time in the failure recorded in the count when the duration is longer than the predetermining duration compared by the microprocessor.

7. The alerting apparatus for fan failure in claim 6, wherein the microprocessor reads a value of phase voltage width of the fan motor, and the microprocessor adds one time in the failure recorded in the count when the value of phase voltage width is higher than the maximum of the predetermining range of phase voltage width, or lower than the minimum of the predetermining range of phase voltage width compared by the microprocessor;

wherein the microprocessor reads a temperature value of the fan motor, and the microprocessor adds one time in the failure recorded in the count when the temperature value of the fan motor is higher than the predetermining value of temperature compared by the microprocessor;

wherein the microprocessor reads a vibrating value of the fan motor, and the microprocessor adds one time in the failure recorded in the count when the vibrating value of the fan motor is higher than the predetermining value of vibrating compared by the microprocessor.

8. The alerting apparatus for fan failure in claim 7, wherein the microprocessor reads a moisture value of the fan motor, and the microprocessor adds one time in the failure recorded in the count when the moisture value of the fan motor is higher than the predetermining value of moisture compared by the microprocessor;

wherein the microprocessor reads an air pressure value of the fan motor, and the microprocessor adds one time in the failure recorded in the count when the air pressure value of the fan motor is lower than the predetermining value of air pressure compared by the microprocessor;

wherein the microprocessor reads an air volume value of the fan motor, and the microprocessor adds one time in the failure recorded in the count when the air volume value of the fan motor is lower than the predetermining value of air volume compared by the microprocessor.

9. The alerting apparatus for fan failure in claim 8, wherein the microprocessor sends a normal status signal in response to the failure recorded in the count is less than or equal to the predetermining time compared by the microprocessor;

wherein the microprocessor sends an alarm signal in response to the failure recorded in the count is larger than the predetermining time compared by the microprocessor.

* * * * *